United States Patent [19]

Singer

[11] Patent Number: 4,836,468

[45] Date of Patent: Jun. 6, 1989

[54] YARN PACKAGE CREEL FOR MACHINE PROCESSING YARN

[76] Inventor: Hans S. Singer, P.O. Box 5861, Greenville, S.C. 29606

[21] Appl. No.: 910,604

[22] Filed: Sep. 23, 1986

[30] Foreign Application Priority Data

May 28, 1986 [CH] Switzerland ..... 02161/86

[51] Int. Cl.[4] ..... B65H 49/10; B65H 49/14

[52] U.S. Cl. ..... 242/131

[58] Field of Search ..... 242/131, 131.1, 130; 139/116, 429, 450; 66/125 R

[56] References Cited

U.S. PATENT DOCUMENTS

| | | | |
|---|---|---|---|
| 1,043,309 | 11/1912 | Fessmann et al. | 242/131.1 X |
| 1,465,359 | 8/1923 | Holt et al. | 242/131 |
| 1,488,123 | 3/1924 | Kershaw | 242/130 |
| 1,578,488 | 3/1926 | Walker | 242/131 X |
| 1,818,223 | 8/1931 | Jordan | 242/130 |
| 1,962,108 | 6/1934 | Cocker | 242/131.1 |
| 2,179,015 | 11/1939 | Lawson | 242/130 |
| 2,483,160 | 9/1949 | Suggs | 242/131.1 |
| 2,534,339 | 12/1950 | Chaya et al. | 242/131 |
| 2,588,053 | 3/1952 | Smith et al. | 242/131 |
| 2,710,155 | 6/1955 | Borges, Jr. | 242/131.1 |
| 2,961,185 | 11/1960 | Seigle | 242/130 |
| 3,102,702 | 9/1963 | Miller | 242/131.1 X |
| 3,236,265 | 2/1966 | Brookshire | 242/131 X |
| 3,321,152 | 5/1967 | Poore et al. | 242/130 |
| 3,610,293 | 10/1971 | Phillips | 242/130 X |
| 3,777,512 | 12/1973 | Burnet et al. | 242/131 X |
| 4,175,717 | 11/1979 | Mathiolon et al. | 242/131 |
| 4,358,068 | 11/1982 | Weiss | 242/131 |
| 4,545,547 | 10/1985 | Singer | 242/131 |

FOREIGN PATENT DOCUMENTS

| | | | |
|---|---|---|---|
| 0050027 | 4/1982 | European Pat. Off. | 242/131 |
| 960856 | 6/1964 | United Kingdom | 242/131 |

*Primary Examiner*—Stanley N. Gilreath

*Attorney, Agent, or Firm*—Bailey & Hardaway

[57] ABSTRACT

An improved creel for machines processing yarn consisting of creel components mounted verically above each other. Creel components are mounted off set above each other to guide yarn between creel component and horizontal creel extension to machine processing yarn. Creel component can rotate to guide one yarn to machine processing yarn or blocked to guide two yarns to machine processing yarn. Storage feeders can be mounted on creel. Improved guidance of yarn with less friction, improved connection of yarn from package to package and holding creel component in stationary position are improved features of this creel for machines processing yarn.

5 Claims, 5 Drawing Sheets

FIG. 4
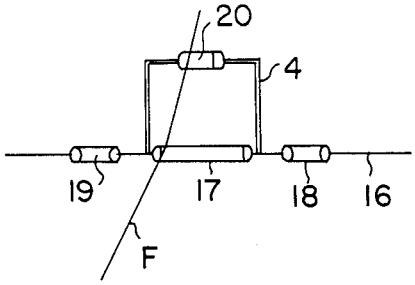
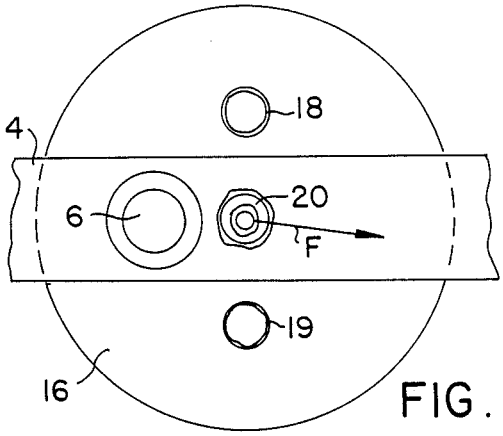
FIG. 4a
FIG. 5
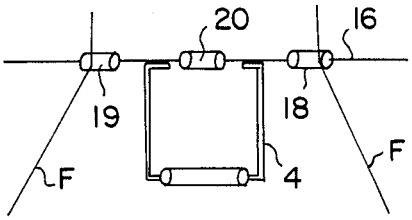
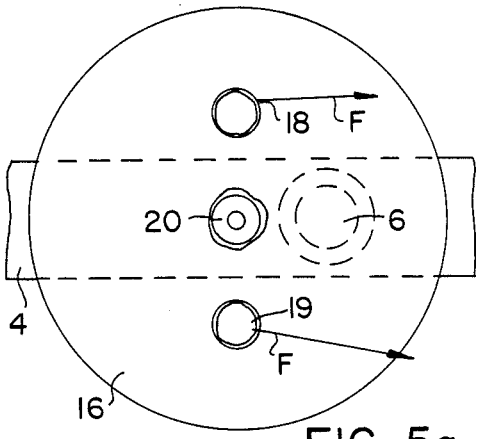
FIG. 5a
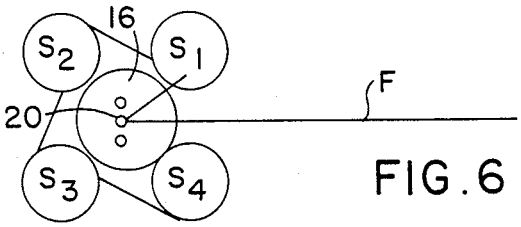
FIG. 6
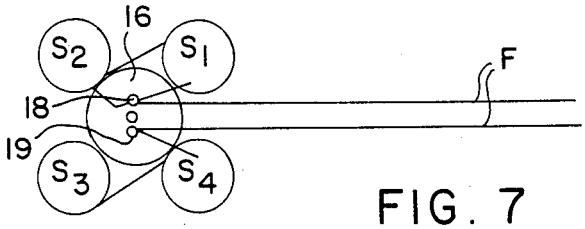
FIG. 7

FIG. 9
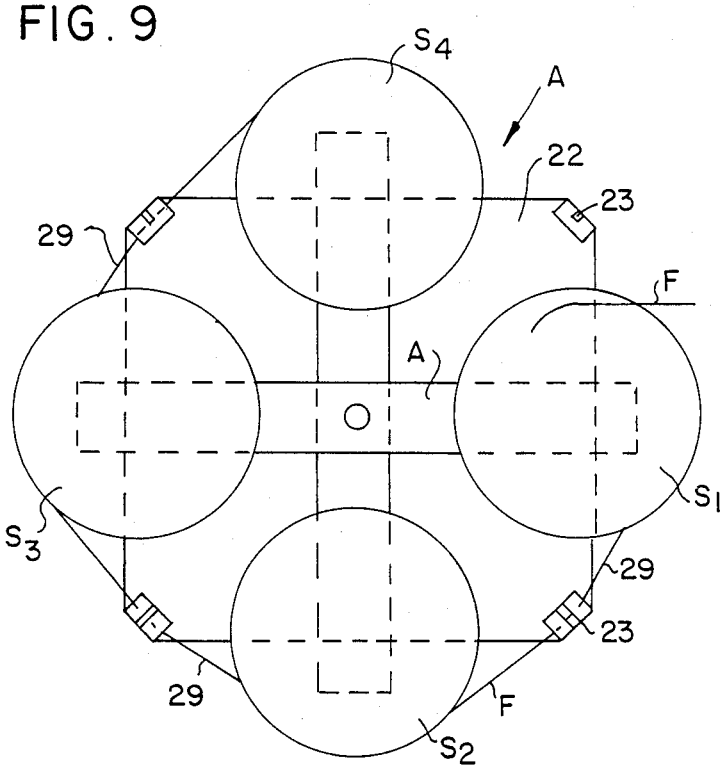
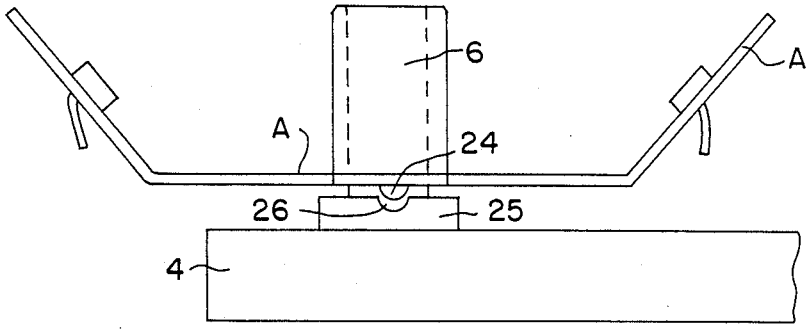
FIG. 10

YARN PACKAGE CREEL FOR MACHINE PROCESSING YARN

BACKGROUND OF THE INVENTION

This is an improvement relating to certain of the disclosures of U.S. Pat. No. 4,545,547. An improved feature contemplates several creel components or crossbrackets spaced vertically above each other. The position of the creel components are preferably offset to aid in guiding yarn. A further improvement contemplates blocking or immobilizing crossbrackets to feed two yarns from a creel component leaving each such yarn connected to one reserve package.

SUMMARY OF INVENTION

The object of the invention is an improved creel to hold yarn packages. Crossbrackets holding four yarn packages form a creel component. Creel components are mounted horizontally above each other in a creel to furnish yarn to a loom or other machine processing yarn. Creel components are mounted offset on horizontal creel extensions to guide yarn between the horizontal creel extensions and the creel components to the loom.

Another object is to mount loom storage feeder devices to the creel.

Another object is to pull one yarn from a creel component through the center of the horizontal creel extensions. This gives three reserve packages for one running yarn. Creel components rotate for easier loading of yarn packages.

When a creel component is blocked as with a set screw to a shaft, two yarns can be pulled from one creel component. This gives one reserve package for each running yarn. This arrangement conserves space.

Another object is to guide yarn through a large cermaic eyelet into a pipe centered above the large ceramic eyelet. This reduces friction of yarn and therefore reduces yarn tension when yarn is running at high speed.

Another object is to mount a plate to a creel component. This plate has slots, lined with felt, between the yarn packages. Yarn can be held tight in the slots when connecting yarn from one yarn package to another yarn package for continuous running.

Another object is to provide the creel component with projections which fall into grooves of a ring when the creel component is rotated. This holds the creel component in stationary position while machine processing yarn is running.

BRIEF DESCRIPTION OF THE DRAWINGS

FIG. 4 is a side elevation illustrating one yarn pulled from a yarn package through the center of a balloon breaker disc and the center of a bracket holding a rotating creel component, FIG. 4*a* is a plan view further illustrating said one yarn of FIG. 4, FIG. 5 is a side elevation illustrating a conversion as a modified form of the invention wherein two yarns are pulled from two yarn supply packages of a blocked creel component through two openings in a balloon breaker disc, FIG. 5*a* is a plan view further illustrating said two yarns of FIG. 5, FIG. 6 is a schematic plan view illustrating pulling one yarn with three reserve packages from a rotating creel component, FIG. 7 is a schematic plan view illustrating pulling two yarns with one reserve package from a blocked creel component, FIG. 9 is a plan view illustrating a creel component with plate to connect yarn packages for continuous running, and FIG. 10 is a schematic side elevation illustrating a creel component held in stationary position.

DESCRIPTION OF A PREFERRED EMBODIMENT

Figure 1:
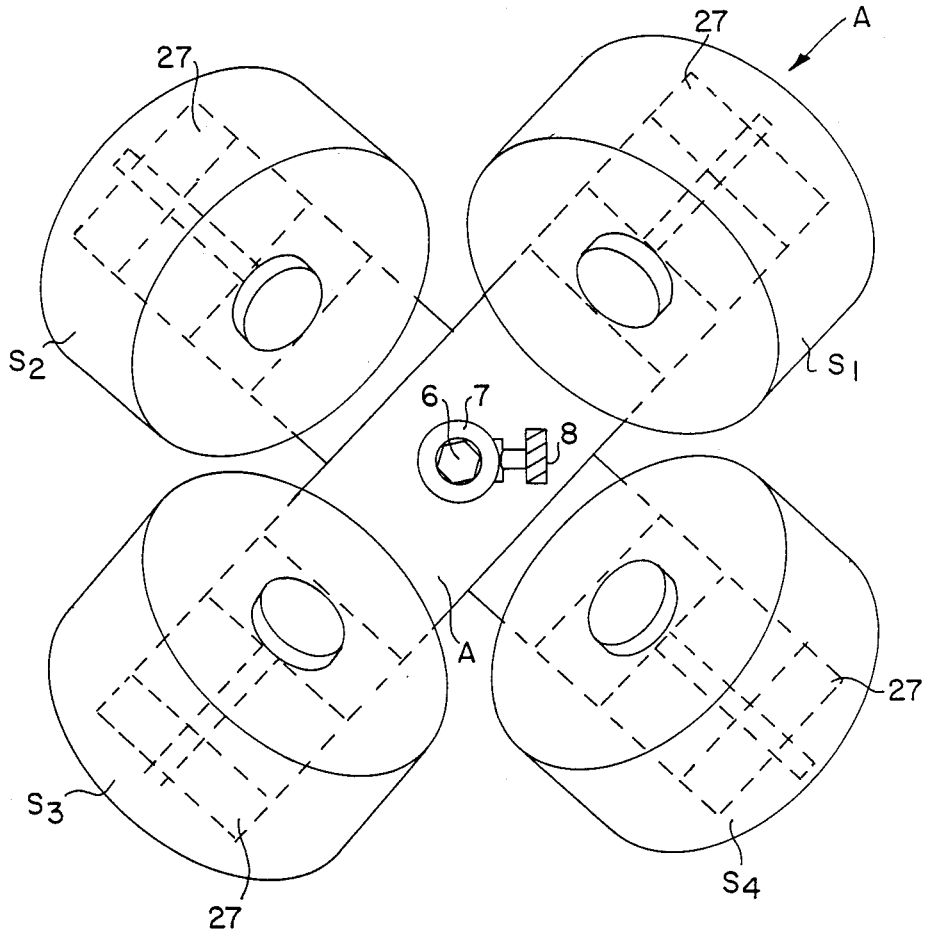
FIG. 1 is a schematic top plan view illustrating a creel component with set screws for blocking, with four yarn packages.

FIG. 1 shows a creel component or crossbracket A with two horizontal flat metal bars welded together forming a cross with four arms. The ends of these arms are bent upwards in an angle of approximately fifty degrees. At the end of these arms, yarn package holders 27 are mounted holding the yarn packages $S_1$, $S_2$, $S_3$ and $S_4$.

Welded to center of creel component A is bushing 7 with set screw 8. The creel component is mounted on shaft 6.

Figure 2:
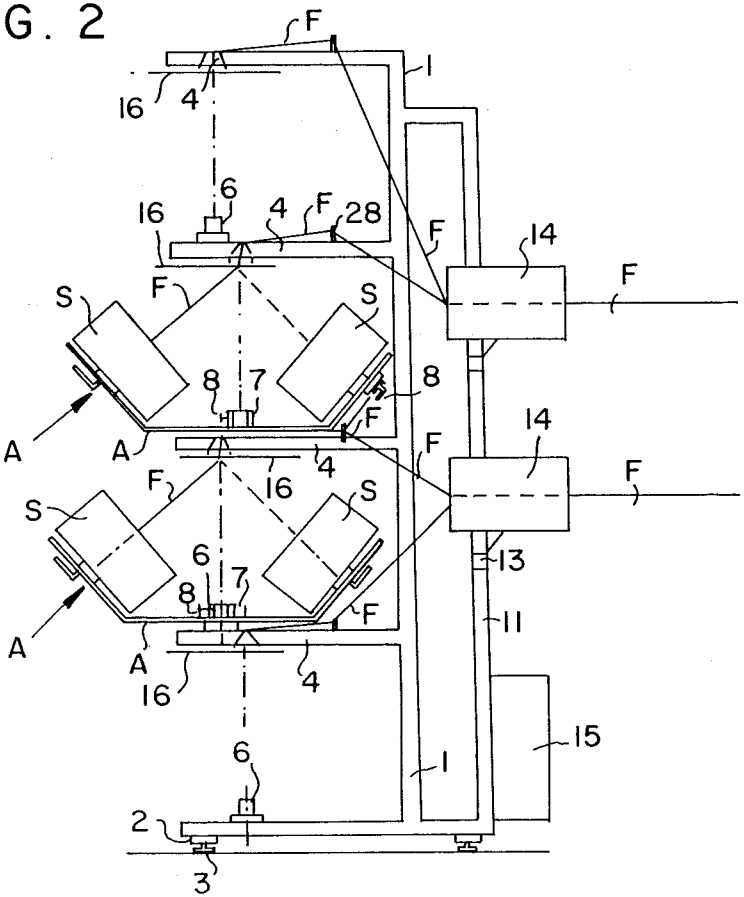
FIG. 2 is a side elevation illustrating a creel for machine processing yarn provided for four off set mounted creel components with storage feeders mounted on creel.

FIG. 2 shows creel 1 for four creel components or crossbrackets A mounted on shafts 6 of horizontal creel extensions 4. Drawing only shows two creel components A. Yarn F is pulled from yarn package S through balloon breaker disc 16 and horizontal creel extension 4 between creel component A and horizontal creel extension 4 to yarn guide 28 to storage feeder 14 to machine processing yarn, or from yarn guide 28 direct to machine processing yarn if storage feeders 14 are not used. In order to pull yarn F through center of horizontal creel extension 4, mounting of shafts 6 have to be offset, otherwise yarn F had to be pulled through shaft 6 and could not be pulled between horizontal creel extension 4 and creel component A. FIG. 2 shows storage feeders 14 mounted on creel 1 with vertical bracket 11 and horizontal bracket extensions 13.

Figure 3:
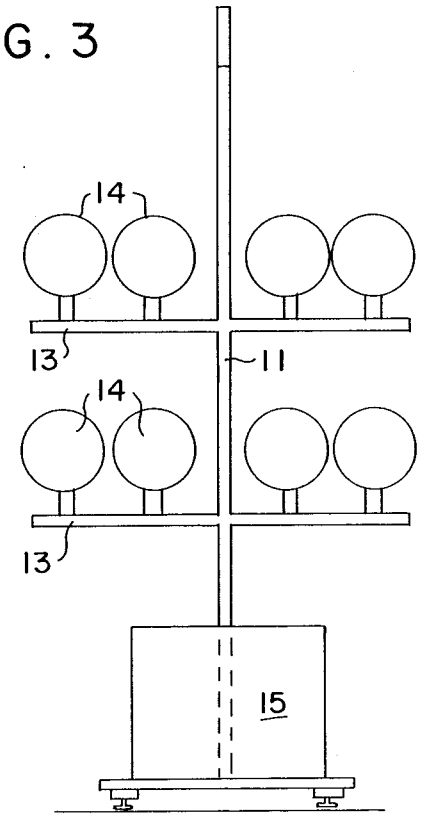
FIG. 3 is a front elevation illustrating storage feeders mounted on creel.

FIG. 3 shows front view of vertical bracket 11 and horizontal extension brackets 13 on which storage feeders are mounted. Storage feeder control box 15 is mounted on bracket 11 or creel 1. This drawing does not show creel 1.

FIG. 4 and 4*a* show horizontal creel extension 4, balloon breaker disc 16 and mounting shaft 6. Yarn F is pulled through center of horizontal creel extension 4 through ceramic eyelet 17 and ceramic eyelet 20 to machine processing yarn. Creel componenet A underneath horizontal creel extension 4 is rotating and one yarn F is pulled from creel component A with three reserve packages.

FIG. 5 and 5*a* show two yarns F pulled through openings in balloon breaker disc 16, provided with ceramic eyelets 18 and 19, to machine processing yarns. Balloon breaker disc 16 is mounted horizontally above extension 4 and the vertical shaft 6 carried thereby.

Creel component A underneath horizontal creel extension 4 is blocked with set screw 8 on shaft 6. Two yarns F are pulled from creel component A with one reserve package.

FIG. 6 shows schematically one yarn F pulled from rotating creel component A. Yarn is pulled from yarn package $S_1$, $S_1$ connects to $S_2$, $S_2$ connects to $S_3$ and $S_3$ connects to $S_4$ for continuous operation. When $S_1$, $S_2$, and $S_3$ are empty, yarn is pulled from $S_4$. Operator replaces empty yarn packages $S_1$, $S_2$ and $S_3$ with full packages and connects them for continuous running. Rotating creel component A simplifies replacement of empty yarn packages from one position.

FIG. 7 shows schematically two yarns F pulled from blocked creel component A. Yarns are pulled from $S_1$ and $S_4$. $S_1$ connects to $S_2$ and $S_4$ connects to $S_3$ for continuous running. Operator replaces empty packages $S_1$ and $S_4$ with full packages and connects $S_2$ with $S_1$ and $S_3$ with $S_4$ for continuous running.

Creel conponent A can be converted from one running yarn with three reserve packages to two running yarns with one reserve package each. Creel 1 with four creel components A can be converted from 4 running yarns to 8 running yarns.

Figure 8:
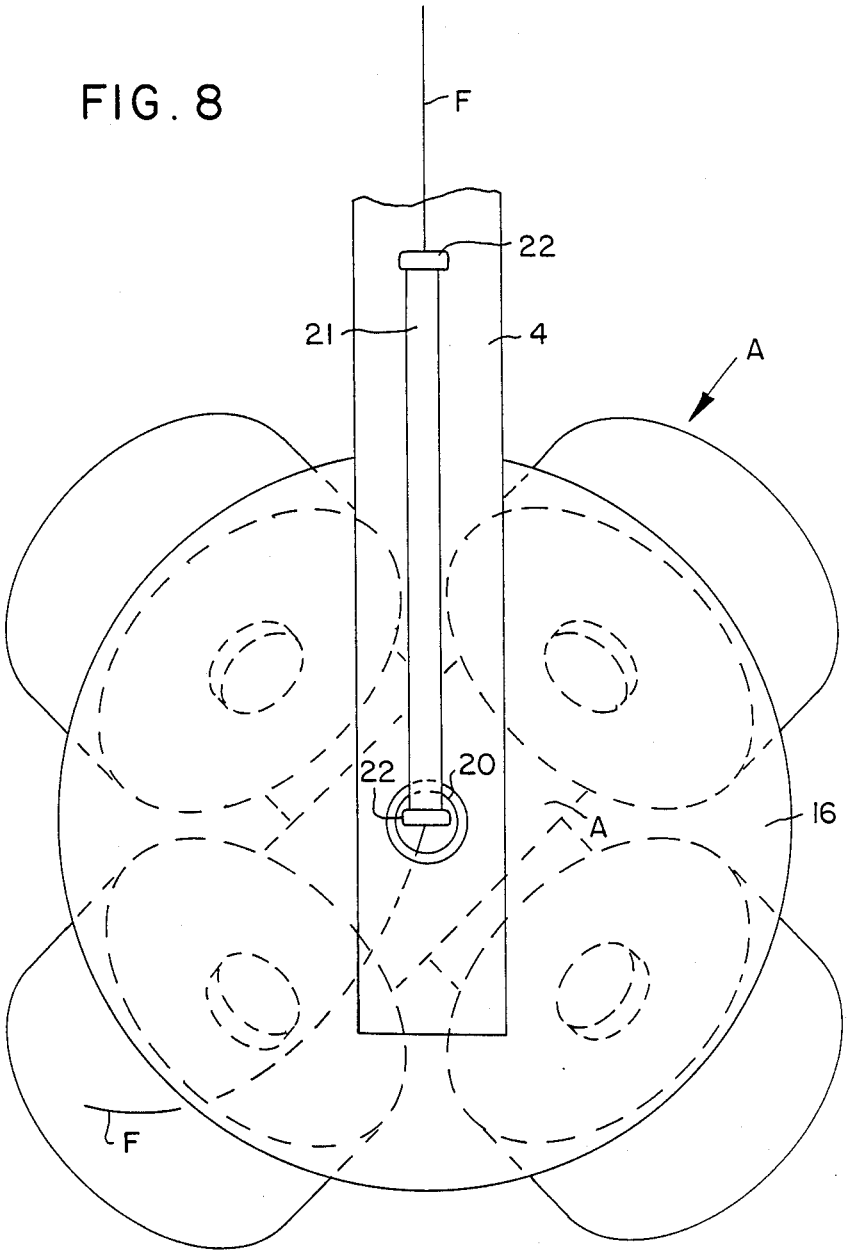
FIG. 8 is a plan view illustrating a tube producing an improved yarn flow for creels operating at a very high yarn speed.

FIG. 8 shows one creel component A with one running yarn and three reserve packages. With only one running yarn F, yarn speed is high creating increased yarn tension at friction points. A large ceramic eyelet 20, not less than 20 mm, mounted in balloon breaker disc 16 and creel extension 4 reduces friction and yarn tension. Yarn F is guided through pipe 21 to machine processing yarn. Pipe 21 has at yarn entrance and yarn exit a ceramic eyelet 22. Pipe 21 is mounted to creel extension 4 that entrance of yarn F into pipe 21 is centered in cermaic eyelet 20. This is an additional reduction of friction points for yarn and reduces yarn tension when yarn F is running at high speed.

FIG. 9 shows creel component A with four yarn packages $S_1$, $S_2$, $S_3$, $S_4$. Plate 22 is mounted on horizontal part of creel component A. Plate 22 is provided with slots 23 between yarn packages. Slots 23 are lined with felt or similar material. Yarn is running from $S_1$ to machine processing yarn. Yarn connecting tail 29 of yarn package $S_1$ is connected to full yarn package $S_2$, yarn connecting tail of $S_2$ is connected to full yarn package $S_3$ and $S_3$ yarn connector tail 29 is connected to full yarn package $S_4$ for continuous operation. To eliminate slack yarn between yarn packages S, yarn is pulled into slots 23 and held tight by felt lined slots.

FIG. 10 shows creel component A mounted on shaft 6 with ring 25 on horizontal creel extension 4. Ring 25 has grooves 26. Creel component A has a projection 24. When creel component A is turned by an operator projection 24 disengages from groove 26 and engages again according to placement of grooves 26 in ring 25. This enables creel component A to remain in a stationary poisition in the most space saving location.

While preferred embodiments of the invention have been described using specific terms, such description is for illustrative purposes only, and it is to be understood that changes and variations may be made without departing from the spirit or scope of the following claims.

What is claimed is:

1. A loom creel having a plurality of vertically spaced crossbrackets each having opposed upturned arms holding a plurality of yarn packages, a package holder mounted on each upturned arm, each crossbracket being carried by a corresponding laterally extending horizontal creel extension carried by a creel frame comprising:

a vertical shaft carried by each corresponding laterally extending horizontal creel extension rotatably carrying each said crossbracket in stacked relation to feed a plurality of yarns from said yarn packages to a loom and the like;

a horizontal balloon breaker member in vertically spaced relation to each said horizontal creel extension; and said crossbrackets being mounted to guide yarns through said balloon breaker members to said loom.

2. The structure set forth in claim 1 wherein storage feeder devices are carried on said creel frame.

3. The structure set forth in claim 1 wherein said vertically spaced crossbrackets are mounted in offset relation;

wherein a central yarn opening is provided in each of said balloon breaker members through which at least one yarn is fed from a yarn package through a balloon breaker member to said loom, and wherein a plurality of reserve yarn packages are mounted on said crossbrackets and tied together for continuous loom operation.

4. The structure set forth in claim 1 wherein blocking means are provided each including two openings in each of said balloon breaker members through which respective yarns are pulled and fed to the loom;

each such yarn being tied together with a reserve yarn package mounted on said crossbracket for continuous operation of said loom; and manually operated means fixing each of said crossbrackets against rotation on said shafts.

5. The structure set forth in claim 1 wherein said crossbrackets have projections for engaging grooves to hold said crossbrackets in stationary position on said vertical shafts.

* * * * *